US007318254B2

(12) United States Patent
Stentenbach

(10) Patent No.: US 7,318,254 B2
(45) Date of Patent: Jan. 15, 2008

(54) FIBER CONVEYING AND DISCARDING DEVICE TO BE CONNECTED TO A CARDER

(75) Inventor: Udo Stentenbach, Nordhorn (DE)

(73) Assignee: Rosink GmbH + Co. KG Maschinenfabrik, Nordhorn (DE)

( * ) Notice: Subject to any disclaimer, the term of this patent is extended or adjusted under 35 U.S.C. 154(b) by 179 days.

(21) Appl. No.: 10/533,792

(22) PCT Filed: Oct. 22, 2003

(86) PCT No.: PCT/DE03/03508

§ 371 (c)(1),
(2), (4) Date: Oct. 17, 2005

(87) PCT Pub. No.: WO2004/044291

PCT Pub. Date: May 27, 2004

(65) Prior Publication Data

US 2006/0196012 A1 Sep. 7, 2006

(30) Foreign Application Priority Data

Nov. 9, 2002 (DE) ..... 102 52 181

(51) Int. Cl.
*D01G 25/00* (2006.01)

(52) U.S. Cl. ..... 19/150

(58) Field of Classification Search ..... 19/150, 19/159 R

See application file for complete search history.

(56) References Cited

U.S. PATENT DOCUMENTS

| | | | | |
|---|---|---|---|---|
| 2,897,550 | A | 8/1959 | Carmichael et al. | 19/159 |
| 3,938,222 | A | 2/1976 | Garrison | 19/159 |
| 5,208,946 | A * | 5/1993 | Stentenbach | 19/159 R |
| 5,745,956 | A * | 5/1998 | Patelli et al. | 19/106 R |
| 5,774,940 | A | 7/1998 | Clapp et al. | 19/159 |
| 5,855,043 | A | 1/1999 | Leifeld | 19/159 |
| 6,199,411 | B1 * | 3/2001 | Schenck et al. | 68/22 R |
| 6,305,527 | B1 | 10/2001 | Bungter | 198/465.2 |
| 6,675,442 | B2 * | 1/2004 | Reinehr et al. | 19/159 R |
| 2001/0042674 | A1 | 11/2001 | Bungter | 198/465.2 |

FOREIGN PATENT DOCUMENTS

| | | |
|---|---|---|
| GB | 1 436 029 | 5/1976 |

* cited by examiner

*Primary Examiner*—Shaun R. Hurley
(74) *Attorney, Agent, or Firm*—Gudrun E. Huckett

(57) ABSTRACT

In a sliver conveying and depositing device, the sliver is guided from the carder through a draw frame to a can coiler. A first deflection device mounted on the free end of a pivotable arm is arranged between the last driven roller pair of the draw frame and the can coiler. The sliver is guided across the first deflection device and the arm exerts a counter pressure onto the sliver for maintaining sliver tension. The first deflection device is displaceable for compensating the sliver length between first and second end positions, wherein signal transducers emit a signal when the first or second positions are reached. The speed of the can coiler drive is changed when a signal is received from the signal transducers, wherein a time interval elapsed since the last signal has been received from one of the signal transducers is taken into account for changing the speed.

12 Claims, 2 Drawing Sheets

FIBER CONVEYING AND DISCARDING DEVICE TO BE CONNECTED TO A CARDER

BACKGROUND OF THE INVENTION

The invention relates to a fiber conveying and depositing device to be connected to a carder, wherein a sliver, downstream of the carder exit, passes through a draw frame comprised of at least two driven roller pairs and then reaches a can coiler, wherein the draw frame has a main drive as well as a regulating drive for the last roller pair.

Such a device is disclosed, for example, in letters patent CH 692 349. The sliver leaving the carder reaches first a draw frame and subsequently a can coiler that places the sliver in the form of loops into the can. The draw frame is configured as a regulating draw frame and arranged immediately on top of the can coiler. In this way, it is possible to keep the distance between the exit of the regulating draw frame and the sliver entry opening of the can coiler at a minimum; according to letters patent CH 692 349, this is underscored as being especially advantageous.

With regard to control technology, the device according to said Swiss letters patent is very complex. The principal problem resides in that the working speed of the carder on the one hand, of the draw frame on the other hand, and finally of the can coiler must be adjusted relative to one another in a suitable way. Speed differences must be compensated or regulated. Moreover, according to the Swiss patent it is proposed to incorporate into the control loop the regulating draw frame as well as the drive motor of the carder. This requires that the individual components must be interconnected with one another with regard to control technology. In practice, one is however often faced with the problem of having to mount a can coiler and an interposed draw frame additionally on an already present carder or to retrofit the carder therewith. In such situations, it is often impossible or possible only with high technical expenditure to intervene in the speed control of the carder in the context of an overall regulation of the system.

U.S. Pat. No. 5,774,940 discloses a device in which, for a preset carding speed, a regulation of the roller pairs of the draw frame as well as a separate regulation of the can coiler drive are carried out. Between the regulating draw frame and the can coiler, the sliver is guided as a freely sagging loop. A level sensor detects the height of the loop, and, based on this signal, a speed adjustment for the regulating draw frame on the one hand and the depositing speed of the can coiler on the other hand are derived by means of a process computer.

In practice, it was found that, in the case of modern carders that operate at high sliver speeds and short-wave regulation of the regulating draw frame, the mechanism of the can coiler is overtaxed in regard to following the short-wave regulation of the regulating draw frame in a sufficiently fast way when controlling the depositing speed of the can coiler by means of, for example, a very rapidly operating servo drive. The reason for this resides in relatively large moved masses of the can coiler that, in the case of a sudden speed adjustments, cause high mechanical forces particularly on the bearing of the rotating head of the can coiler.

It is an object of the invention to provide a fiber conveying and depositing device that operates with simple control-technological means and is to be connected to a carder, wherein the device downstream of the exit of the draw frame enables the adjustment and compensation of the sliver speed without having an effect on the sliver quality.

SUMMARY OF THE INVENTION

The solution to this object is characterized for a fiber conveying and depositing device of the aforementioned kind by:

a. deflection means for the sliver arranged between the last roller pair of the draw frame and the can coiler, wherein the deflection means are movable for compensation of the sliver length;
b. signal transducers for a first and a second end positions of the deflection means;
c. means for changing the speed of the can coiler drive upon signal emission by one of the signal transducers and as a function of the time interval elapsed since the last signal emission; and
d. deflection means arranged at the free end of an arm that is pivotable about a pivot axis and that exerts a counter pressure onto the sliver for maintaining an appropriate sliver tension, across which deflection means the sliver is guided at a deflection angle.

Such a fiber conveying and depositing device enables by simple control technological means the adjustment and the compensation of the sliver speeds downstream of the fine-regulating draw frame. According to the invention, the control is based on a spatial movement of deflection means for the sliver, wherein these deflection means can be comprised of, for example, an arm that is pivotable about a pivot axis and has at its free end a roller that is freely rotatably supported thereon across which roller the sliver is guided and deflected. The sliver extends therefore not on a direct path from the last roller pair of the draw frame to the can coiler but follows a "detour" across the displaceable deflection means. This leads, on the one hand, to a certain sliver tension being automatically maintained and the sliver quality leaving the draw frame being retained. On the other hand, there is a detection possibility provided as a result of the spatial movement of the deflection means. According to the invention, this displacement is not detected, for example, by a technically complex level sensor but instead there are only discrete signal transducers for a first and a second end positions of the deflection means. Therefore, it is not the magnitude of the spatial displacement of the deflection means across the entire possible movement range that is detected but only discrete end positions or an approach of such end positions are detected.

Finally, according to the invention, means are provided for changing the drive speed of the can coiler upon signal emission by one of the signal transducers and as a function of the time interval elapsed since the last signal emission. Only when one of the end positions is reached, an adjustment of the basic transmission is realized by intervention in the working speed of the can coiler. The longer the time interval between sequentially reaching the end positions, the smaller the speed adjustment of the can coiler.

The intervention in the often completely independent control of the carder is not required so that the sliver conveying and depositing device according to the invention is suitable also for retrofitting an already present carder or subsequently attaching it thereto. Since as an initial parameter of the control only two end positions and not, for example, all intermediate values must be detected, the control technological expenditure is minimal despite high sliver speeds being obtainable.

Also advantageous is the calm running of the sliver by guiding the sliver across the spatially displaceable deflection means that can no longer affect the quality of the sliver reached at the time of leaving the draw frame. Especially at the desired high sliver speeds such a sliver guiding action is characterized by a calmer conveying action of the sliver as compared to, for example, a freely sagging loop as disclosed in connection with a continuously operating level sensor in U.S. Pat. No. 5,774,940. An additional disadvantage of a level sensor for detecting a sagging sliver loop resides in that the undefined sagging of the sliver loop can lead precisely to such distortions within the sliver that have been removed prior within the regulating draw frame.

In accordance with a preferred embodiment of the fiber conveying and depositing device, it is proposed that for detection of the two end positions two signal transducers are provided, respectively, and arranged minimally displaced relative to one another. In this way, an approach of the end position can already be detected signal-technologically and, accordingly, the control can be refined. As signal transducers, proximity switches are preferably used.

A further embodiment is characterized by a deflection means in the form of a roller that is arranged to be freely rotatable at the free end of a swivel arm that is pivotable about a pivot axis. Roller and arm are preferably pretensioned relative to the sliver, for example, by a weight element arranged on the arm or by a spring.

For the swivel arm an especially light-weight and thus almost inertia-free construction is proposed according to which the arm is comprised of a thin-walled tube. Particularly suitable is a tube of carbon fibers which combines the advantage of minimal weight with high strength and substantial freedom of vibration. Such an arm operates with very minimal inertia moments and therefore has excellent response behavior in regard to any extension or shortening of the sliver deflected about the arm.

An additional roller that is stationarily supported on the pivot axis for the arm and acts in this case as an additional deflection means also contributes to improving the response behavior of the deflection means relative to any length change of the sliver. Preferably, for this purpose the pivot axis for the arm is arranged above the can coiler and the sliver is vertically guided between the additional roller and the can coiler such that the sliver reaches the can coiler on the shortest possible path and vertically from top to bottom.

For obtaining an exact response behavior of the deflection means, it is advantageous when the deflection means can be displaced only relative to a certain counterforce, for which purpose preferably a damping mechanism is used. Accordingly, one embodiment of the device is characterized in that the deflection means are provided with a damping element having a progressive damping characteristic line and acting in the displacement direction so that vibrations that are unfavorable for regulating the can coiler are substantially prevented. Preferably, the damping element is arranged such that it acts in a damping fashion on the pivot axis of the swivel arm.

BRIEF DESCRIPTION OF THE DRAWINGS

Further details of the invention will be explained in the following with the aid of an embodiment and with reference to the drawings. It is shown in.

DESCRIPTION OF PREFERRED EMBODIMENTS

Figure 1:
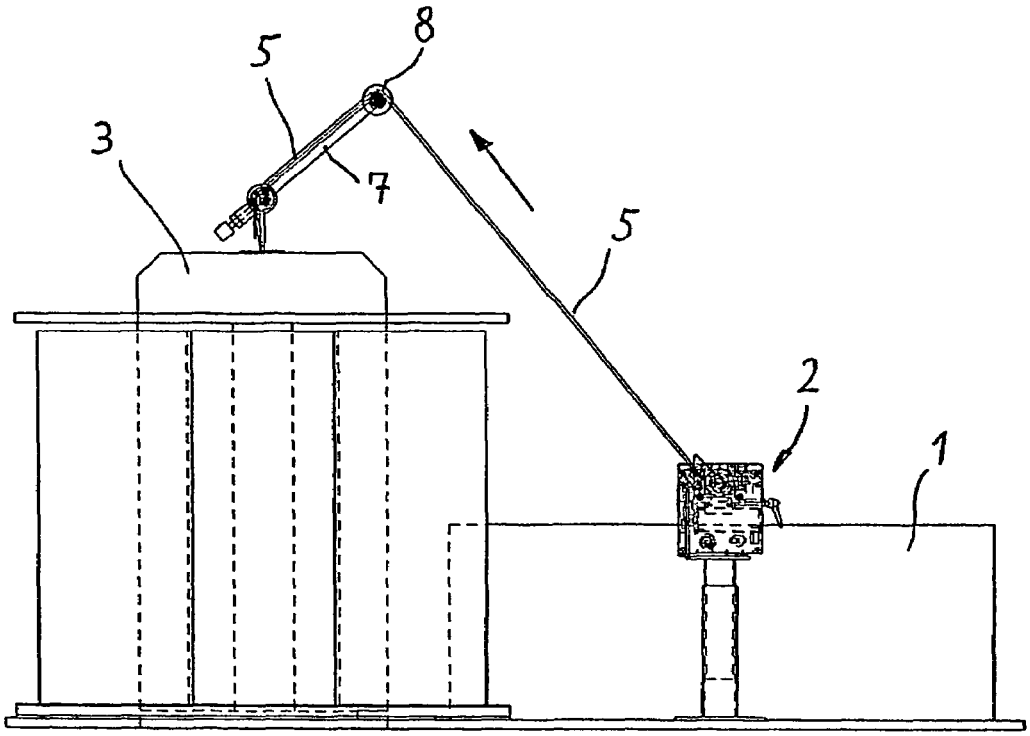
FIG. 1 in a side view a draw frame mounted on a carder as well as a can coiler downstream of this draw frame, wherein the can coiler is prepared for receiving a total of three sliver cans.
Figure 2:
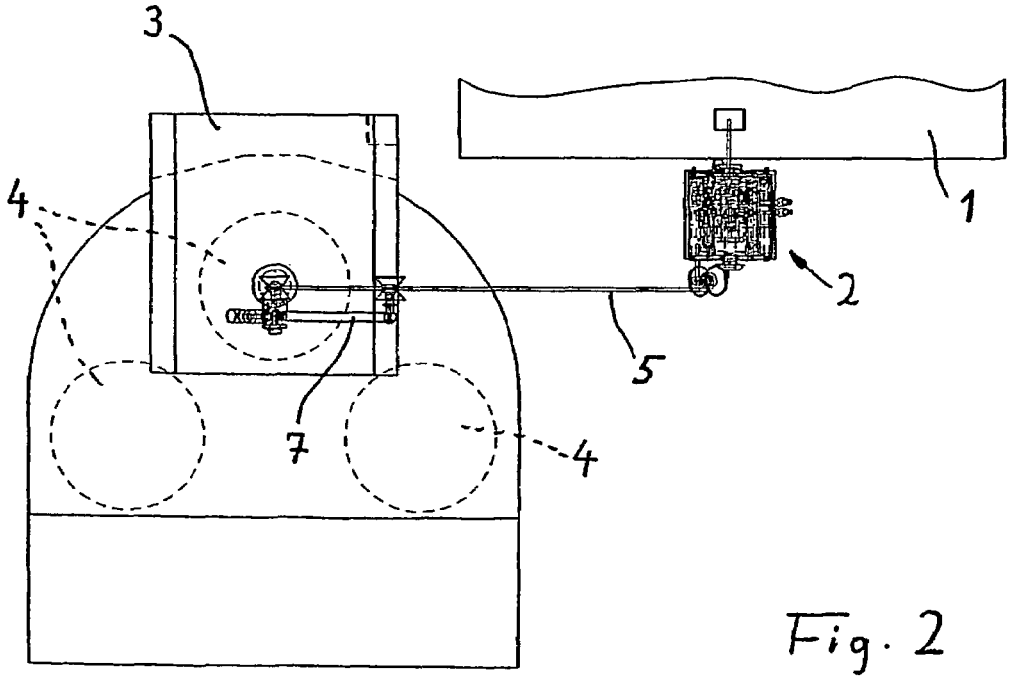
FIG. 2 the objects of FIG. 1 in a plan view.

FIGS. 1 and 2 show in an overall illustration a carder 1, only partially illustrated, that has arranged downstream thereof a draw frame 2 relative to the sliver conveying direction; downstream of the draw frame a can coiler 3 is arranged. In the can coiler 3, a can is deposited, as is known in the art, into which can the sliver is placed in loops in a controlled fashion. In the present case, the can coiler 3 is provided with a can changer which provides space for a total of three sliver cans 4. The sliver is identified by reference character 5.

A controlled drawing of the sliver coming from the carder 1 is realized in the draw frame 2 in order to improve in this way the structure and in particular the uniformness of the sliver. Such draw frames are also known, for example, as disclosed in Swiss letters patent CH 692 349. A draw frame is often comprised of several roller pairs wherein at least the last roller pair is driven at a higher individually controllable speed. This speed difference effects drawing and uniformness of the sliver.

The draw frame 2 is therefore configured as a regulating draw frame and comprises a main drive as well as a separate quickly acting regulating drive. The main drive has a fixed transmission relative to the carder 1 that is however programmable with regard to its magnitude. The regulating drive has a fixed basic transmission that can also be programmed with regard to its magnitude relative to the drive of the can coiler 3.

For obtaining the desired structure of the sliver, the last roller pair and optionally also the last roller pairs of the draw frame 2 that are often referred to as the draw frame exit rollers can be accelerated or decelerated suddenly by the quickly acting regulating drive relative to the basic transmission. For example, by means of a quickly acting servo drive, the exit rollers can be changed with regard to their speed by up to 25% at a frequency in the millisecond range. The can coiler 3 downstream of the draw frame 2 cannot follow such a quick acting speed change because its mechanical drive components react too sluggishly. As a result of this, there are almost always speed differences.

As a result of the different dynamics of the regulating draw frame on the one hand and of the can coiler on the other hand, there are also changes of the effective sliver length of the sliver on the path from the draw frame 2 to the can coiler 3. These length changes are compensated quickly in that the sliver 5 on its path from the draw frame 2 to the can coiler 3 is guided across the free end of a swivel arm 7 that is pivotable about pivot axis 6. Because it is pivotable about the pivot axes 6, the arm 7 or a freely rotatable roller 8 provided at its free end constitute a deflection means for the sliver that is displaceable in accordance with the effective sliver length. By a defined counterforce that is generated preferably by a counterweight, the arm 7 is maintained at a constant counter pressure so that the sliver 5 on its path from the draw frame to the can coiler remains uniformly tensioned. This tension is so minimal that the structure of the sliver present when the sliver exits the draw frame 2 is not affected.

Based on FIGS. 3 to 6, details of the deflection means comprised primarily of the arm 7 and the roller 8 rotatably supported thereon will be explained in the following.

On the topside of the can coiler, a short stand 11 is attached that has at its upper end a bearing for the pivot axis 6 of the arm 7. The arm 7 is therefore pivotable about axis 6 wherein damping elements 16 in the area of the pivot axis 6 exert a progressive damping action onto the rotational movement of the arm, i.e., the greater the rotary speed of the arm 7, the greater the damping action. The long lever of the arm 7 is comprised of a tube 9 having at its free end the already described roller 8 supported so as to be freely rotatable thereon. The tube 9 is comprised of a very light-weight material that is essentially vibration-free and has a high strength, for example, carbon fiber.

The short lever of the arm 7 is formed by the weight element 10. The weight element 10 is positioned as close as possible to the pivot axis 6 of the arm in order to position the inertia forces close to the center of the pivot action. The weight element 10 is screwed by means of an adjusting thread 12 with a lock nut 13 into the arm 7 wherein the leverage of the weight element can be adjusted by adjusting this thread.

Figure 3:
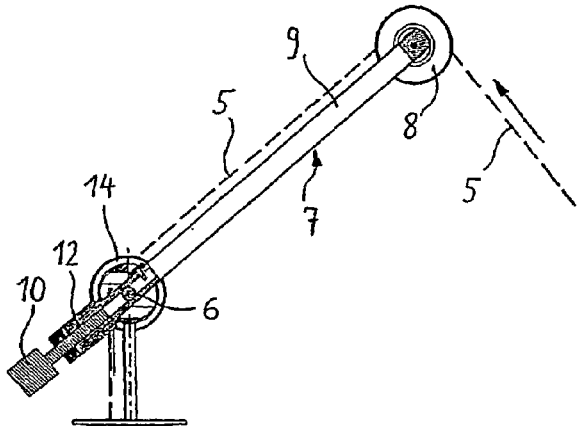
FIG. 3 in a section illustration an arm arranged on the can coiler across which the sliver is deflected on its way from the draw frame to the can coiler.

The weight element 10 that acts as a counterweight for the long arm 7 as well as the roller 8 is dimensioned and tared such that the roller 8 at the free end of the tube 9 always exerts a certain tension onto the sliver 5 guided about this roller 8. In this connection, it is advantageous when the sliver 5, as illustrated in FIG. 3, is guided in the central position of the arm 7 at a deflection angle of approximately 90° across the roller 8.

Figure 4:
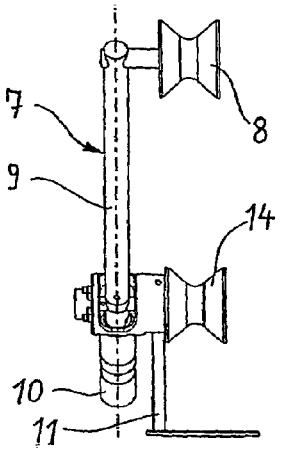
FIG. 4 the arm according to FIG. 3 in a view rotated relative to FIG. 3 by 90°.

FIG. 4 illustrates in a different view that the deflection means for the sliver include in addition to the movable roller 8 also an additional roller 14. The additional roller 14 is freely rotatably supported on the pivot axis 6 of the arm 7. Moreover, the roller 14 is arranged such that the sliver 5 guided across it moves subsequently vertically into the can coiler 3 arranged underneath.

Figure 5:
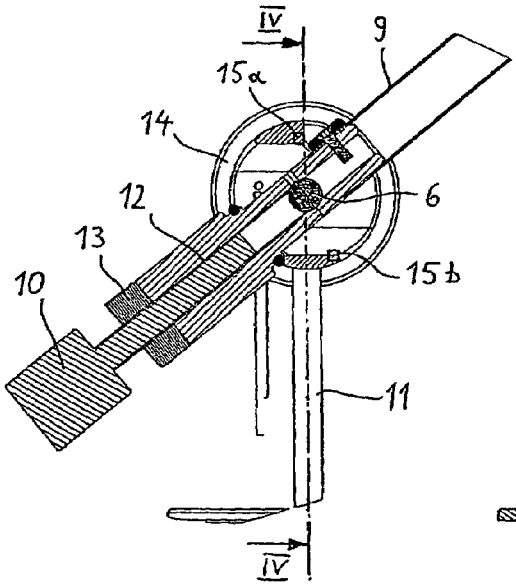
FIG. 5 an enlarged view of the detail of FIG. 3.
Figure 6:
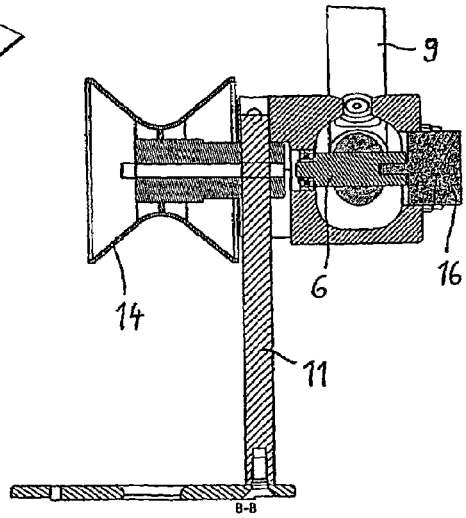
FIG. 6 a section in the plane VI-VI indicated in FIG. 5 of the bearing of the swivel arm.

According to FIGS. 5 and 6, the pivot movement of the rolling bearing-supported arm 7 is delimited by two end positions each of which is detectable. For this purpose, a first signal transducer 15*a* for the first end position of the arm and a second signal transducer 15*b* for the second end position of the arm are integrated into the swivel joint. Preferably, each of the two signal transducers 15*a*, 15*b* includes also a pre-signal transducer that is spatially slightly advanced so that already an approach of the end positions can be detected. Intermediate positions of the arm 7 on the other hand are not detected by sensors; instead, a signal emission is carried out only when the arm 7 approaches at least one of the two end positions.

FIG. 6 shows also a damping element 16 which operates progressively and which exerts a higher damping force onto the pivot axis 6 of the arm the greater the displacement speed of the arm. This damping action leads to a calming of the arm relative to short-wave vibration amplitudes.

Because of the especially light-weight construction of the arm 7 the sliver tension of the sliver 5 placed across it is maintained constant; also, the short-wave and long-wave transmission changes are compensated well.

The detection signal of the end position signal transducers 15*a*, 15*b* are transmitted to a central control unit that calculates based thereon a speed change for the basic adjustment of can coiler 3. When, for example, the arm 7 approaches with its roller 8 the lower end position, which is equal to a shortening of the sliver length between draw frame and can coiler, the central control unit calculates a deceleration of the basic speed of the can coiler 3. When, on the other hand, the arm 7 rises with its roller 8, which is equal to a lengthening of the sliver section between the draw frame and the can coiler, the basic speed of the can coiler is increased, and thus also the drive speed of the can coiler. For this purpose, the central control unit is connected to a controller that provides appropriate drive commands in order to carry out in this way an adjustment and thus regulation of the basic transmission of the regulating draw frame relative to the can coiler. The control loop further takes into consideration the time interval that has elapsed since the last signal emission by the signal transducers 15*a*, 15*b*. The greater this time interval, the smaller the adjustments of the speed of the can coiler drive that are calculated by the central control unit. This evaluation that also includes temporal data leads to a significant calming of the control behavior and, in this way, the optimum basic transmission is found automatically.

LIST OF REFERENCE NUMERALS

1 carder
to draw frame
3 can coiler
4 sliver can
5 sliver
6 pivot axis
7 arm
8 roller
9 tube
10 weight element
11 stand
12 adjusting thread
13 lock nut for the weight element
14 roller
15*a* signal transducer
15*b* signal transducer
16 damping

What is claimed is:

1. A sliver conveying and depositing device to be connected to a carder, wherein a sliver exiting from a carder exit passes through a draw frame comprised of at least two driven roller pairs and then reaches a can coiler, wherein the draw frame has a main drive for the at least two driven roller pairs and a regulating drive for a last one of the at least two driven roller pairs in a sliver conveying direction; the device comprising:

a first deflection means arranged between the last one of the at least two driven roller pairs and the can coiler;

an arm that is pivotable about a pivot axis wherein the first deflection means is arranged at a free end of the arm;

wherein the sliver is guided across the first deflection means at a deflection angle;

wherein the arm exerts a counter pressure onto the sliver for maintaining a sliver tension;

wherein the first deflection means is displaceable for compensation of a length of the sliver and has a first end position and a second end position;

signal transducers for emitting a signal when the first end position or the second end position of the first deflection means has been reached, respectively;

means for changing a speed of a can coiler drive when one of the signal transducers emits the signal, wherein a time interval elapsed since the last signal has been emitted by one of the signal transducers is taken into account for changing the speed;

wherein two of the signal transducers are arranged slightly displaced relative to one another for detecting the first end position and for detecting the second end position, respectively.

2. The sliver conveying and depositing device according to claim 1, wherein the signal transducers are proximity switches.

3. A sliver conveying and depositing device according to claim 1, wherein the first deflection means is a roller arranged on the arm so as to be freely rotatable.

4. A sliver conveying and depositing device to be connected to a carder, wherein a sliver exiting from a carder exit passes through a draw frame comprised of at least two driven roller pairs and then reaches a can coiler, wherein the draw frame has a main drive for the at least two driven roller pairs and a regulating drive for a last one of the at least two driven roller pairs in a sliver conveying direction; the device comprising:

a first deflection means arranged between the last one of the at least two driven roller pairs and the can coiler;

an arm that is pivotable about a pivot axis wherein the first deflection means is arranged at a free end of the arm;

wherein the sliver is guided across the first deflection means at a deflection angle;

wherein the arm exerts a counter pressure onto the sliver for maintaining a sliver tension;

wherein the first deflection means is displaceable for compensation of a length of the sliver and has a first end position and a second end position, wherein the first deflection means is a roller arranged on the arm so as to be freely rotatable;

signal transducers for emitting a signal when the first end position or the second end position of the first deflection means has been reached, respectively;

means for changing a speed of a can coiler drive when one of the signal transducers emits the signal, wherein a time interval elapsed since the last signal has been emitted by one of the signal transducers is taken into account for changing the speed;

a weight element arranged on the arm for pretensioning the roller and the arm against the sliver.

5. The sliver conveying and depositing device according to claim 4, wherein two of the signal transducers are arranged slightly displaced relative to one another for detecting the first end position and for detecting the second end position, respectively.

6. The sliver conveying and depositing device according to claim 4, wherein the arm is a swivel arm comprised of a thin-walled tube.

7. The sliver conveying and depositing device according to claim 6, wherein the thin-walled tube is comprised of carbon fiber.

8. A sliver conveying and depositing device to be connected to a carder, wherein a sliver exiting from a carder exit passes through a draw frame comprised of at least two driven roller pairs and then reaches a can coiler, wherein the draw frame has a main drive for the at least two driven roller pairs and a regulating drive for a last one of the at least two driven roller pairs in a sliver conveying direction: the device comprising:

a first deflection means arranged between the last one of the at least two driven roller pairs and the can coiler;

an arm that is pivotable about a pivot axis wherein the first deflection means is arranged at a free end of the arm;

wherein the sliver is guided across the first deflection means at a deflection angle;

wherein the arm exerts a counter pressure onto the sliver for maintaining a sliver tension;

wherein the first deflection means is displaceable for compensation of a length of the sliver and has a first end position and a second end position, wherein the first deflection means is a roller arranged on the arm so as to be freely rotatable;

signal transducers for emitting a signal when the first end position or the second end position of the first deflection means has been reached, respectively;

means for changing a speed of a can coiler drive when one of the signal transducers emits the signal, wherein a time interval elapsed since the last signal has been emitted by one of the signal transducers is taken into account for changing the speed;

a second deflection means that is an additional roller, wherein the additional roller is stationarily supported on the pivot axis of the arm.

9. The sliver conveying and depositing device according to claim 8, wherein the pivot axis of the arm is arranged above the can coiler and the sliver is guided vertically between the additional roller and the can coiler.

10. A sliver conveying and depositing device to be connected to a carder, wherein a sliver exiting from a carder exit passes through a draw frame comprised of at least two driven roller pairs and then reaches a can coiler, wherein the draw frame has a main drive for the at least two driven roller pairs and a regulating drive for a last one of the at least two driven roller pairs in a sliver conveying direction; the device comprising:

a first deflection means arranged between the last one of the at least two driven roller pairs and the can coiler;

an arm that is pivotable about a pivot axis wherein the first deflection means is arranged at a free end of the arm;

wherein the sliver is guided across the first deflection means at a deflection angle;

wherein the arm exerts a counter pressure onto the sliver for maintaining a sliver tension;

wherein the first deflection means is displaceable for compensation of a length of the sliver and has a first end position and a second end position;

signal transducers for emitting a signal when the first end position or the second end position of the first deflection means has been reached, respectively;

means for changing a speed of a can coiler drive when one of the signal transducers emits the signal, wherein a time interval elapsed since the last signal has been emitted by one of the signal transducers is taken into account for changing the speed;

wherein the first deflection means has a damping element having a progressive damping characteristic line and acting in a displacement direction of the first deflection means.

11. The sliver conveying and depositing device according to claim 10, further comprising a weight element arranged on the arm for pretensioning the first deflection means and the arm against the sliver, wherein the damping element acts on the pivot axis of the arm.

12. A sliver conveying and depositing device to be connected to a carder, wherein a sliver exiting from a carder exit passes through a draw frame comprised of at least two driven roller pairs and then reaches a can coiler, wherein the draw frame has a main drive for the at least two driven roller pairs and a regulating drive for a last one of the at least two driven roller pairs in a sliver conveying direction; the device comprising:

a first deflection means arranged between the last one of the at least two driven roller pairs and the can coiler;

an arm that is pivotable about a pivot axis wherein the first deflection means is arranged at a free end of the arm;

wherein the sliver is guided across the first deflection means at a deflection angle;

wherein the arm exerts a counter pressure onto the sliver for maintaining a sliver tension;

wherein the first deflection means is displaceable for compensation of a length of the sliver and has a first end position and a second end position;

signal transducers for emitting a signal when the first end position or the second end position of the first deflection means has been reached, respectively;

means for changing a speed of a can coiler drive when one of the signal transducers emits the signal, wherein a time interval elapsed since the last signal has been emitted by one of the signal transducers is taken into account for changing the speed;

wherein the signal transducers are proximity switches.

* * * * *